US006854219B1

(12) United States Patent
Kelly et al.

(10) Patent No.: US 6,854,219 B1
(45) Date of Patent: Feb. 15, 2005

(54) ADJUSTABLE APPARATUS AND METHOD FOR SUPPORTING A CONCEALED SPINE WITHIN A MASONRY LINTEL

(75) Inventors: David L. Kelly, Sacramento, CA (US); Michael J. Recker, Spring Branch, TX (US)

(73) Assignee: Meadow Burke Products, Sacramento, CA (US)

( * ) Notice: Subject to any disclaimer, the term of this patent is extended or adjusted under 35 U.S.C. 154(b) by 250 days.

(21) Appl. No.: 10/213,563

(22) Filed: Aug. 8, 2002

(51) Int. Cl.[7] ..... E04B 1/32

(52) U.S. Cl. ..... 52/86; 52/64; 52/80.1; 52/245

(58) Field of Search ..... 52/3–5, 64, 73–78, 52/80.1, 80.2–80.6, 85, 86, 245, 246, 247, 248, 249, 87, 88, 89, 65–72

(56) References Cited

U.S. PATENT DOCUMENTS

| | | | | |
|---|---|---|---|---|
| 3,421,269 A | * | 1/1969 | Medow | 52/86 |
| 4,020,612 A | | 5/1977 | Welch | |
| 4,202,143 A | | 5/1980 | Mear et al. | |
| 4,702,044 A | * | 10/1987 | Dominguez | 52/86 |
| 4,757,656 A | | 7/1988 | Powers, Jr. | |
| 5,218,801 A | | 6/1993 | Hereford | |
| 5,465,538 A | | 11/1995 | Powers, Jr. | |
| 5,893,254 A | | 4/1999 | Troiani et al. | |

OTHER PUBLICATIONS

Kenneth A. Hooker, No Visible Means of Support, Masonry Construction, Dec. 1991, pp. 1–7.

* cited by examiner

*Primary Examiner*—Jeanette Chapman
(74) *Attorney, Agent, or Firm*—Thelen Reid & Priest LLP

(57) ABSTRACT

A masonry lintel having a concealed spine which spans between piers to either side of an area to be arched and supports masonry bricks through means of horseshoe shaped plates which ride on the spine. The bricks are supported on the spine by stitching rods which extend through apertures in the plates and the bricks. The plates are received in the grouting space between the bricks and, in the finished lintel, are grouted over to be completely hidden from view. Variations in the relative positions of the piers and the width of bricks used to construct the lintel are accommodated by adjustable supports between the spine and the piers which enable the position of the spine relative to the piers to be selectively adjusted. In the embodiments employing multiple generally parallel spines, these supports provide for adjustable spacing of the spines. Center supports for the spines are adjustable both vertically and horizontally to accommodate various structural design parameters.

21 Claims, 9 Drawing Sheets

ADJUSTABLE APPARATUS AND METHOD FOR SUPPORTING A CONCEALED SPINE WITHIN A MASONRY LINTEL

BACKGROUND OF THE INVENTION

The present invention relates to an improved apparatus and method for use in supporting masonry lintels and, more particularly it is directed to a system for adjustably supporting a spine to be concealed within the lintel. In its more specific aspects, the invention is concerned with such a support system which enables the use of a concealed support, maintains the standard grout width and accommodates various widths of masonry and various tolerances, without requiring a precisely pre-constructed lintel support for each job.

It is well known in the art to use supports for masonry lintels. Most of these supports, however, are disposed beneath the lintel and, accordingly, exposed to view. See, e.g., U.S. Pat. Nos. 4,020,612, 4,202,143, 4,757,656, 5,465,558 and the exposed roof truss of U.S. Pat. No. 5,218,801. It is also known to reinforce brick walls supported on piers through means of internal reinforcing elements which extend longitudinally through a passage therefor in the wall so that the elements are concealed, as may be seen from U.S. Pat. No. 5,893,254.

The prior art concealed lintel system of HALFEN Anchoring Systems employs a steel spine that spans the opening being arched and rests on bearing plates at each end. Cored bricks are suspended from the spine through means of "horseshoe" plates that hang on the spine at every third brick joint and stitching rods which extend through openings in the plates and the bricks. During the course of construction, the bricks are supported on a framework and the openings in the bricks and plates, with the rods extending therethrough are packed with mortar. Grout is placed between the bricks, with the result that the spine support is totally concealed. The bearing plates supporting the spine on the piers are welded to the spine and grouted into place on the piers.

The present invention is an improvement over the concealed lintel system of HALFEN in that the bearing plates at either end of the spine are adjustable to accommodate various size and tolerance masonry units and maintain a standard grout width. As a result, the spine of the present invention does not need to be custom designed and fabricated for each project, as was necessary with the welded spine and support plate construction of the prior art HALFEN System.

SUMMARY OF THE INVENTION

The apparatus of the invention is for use in combination with a lintel support comprising a first spine member extending between piers disposed to either side of an area to be arched and support plates mounted on the spine member to suspend cored bricks from the member through means of stitching rods extending through apertures in the plates and bricks. The improvement of the inventive apparatus comprises separate bearing plates on each of the piers to support the spine member, and attachment means to selectively secure the spine member to the bearing plates at different positions of adjustment relative to the plates. Multiple spine embodiments of the invention further include means connecting the spines to the bearing plates which provide for selective adjustment of the relative spacing between the spines. The inventive apparatus may also provide adjustable intermediate supports to suspend the spines from support structure disposed between the piers.

In the method of the invention, a spine member to be concealed within a masonry lintel rests on support structure disposed to one end of the lintel. The method provides an adjustable support between the structure and the spine member to accommodate adjustment of the spine member relative to the structure. The support is adjusted to dispose the spine member in a desired condition of adjustment relative to the structure and then secured to maintain the desired condition of adjustment.

A principal object of the invention is to provide a concealed support system for a masonry lintel which will accommodate last minute adjustments and allow for variations in the sizes of the bricks used to construct the lintel. Another general and related object is to provide an adjustable support system for a concealed masonry lintel which allows adjustments for as built variations in the masonry. These and other objects of the invention will become more apparent when viewed in light of the following detailed description in the accompanying drawings.

DESCRIPTION OF THE PREFERRED EMBODIMENTS

Figure 1:
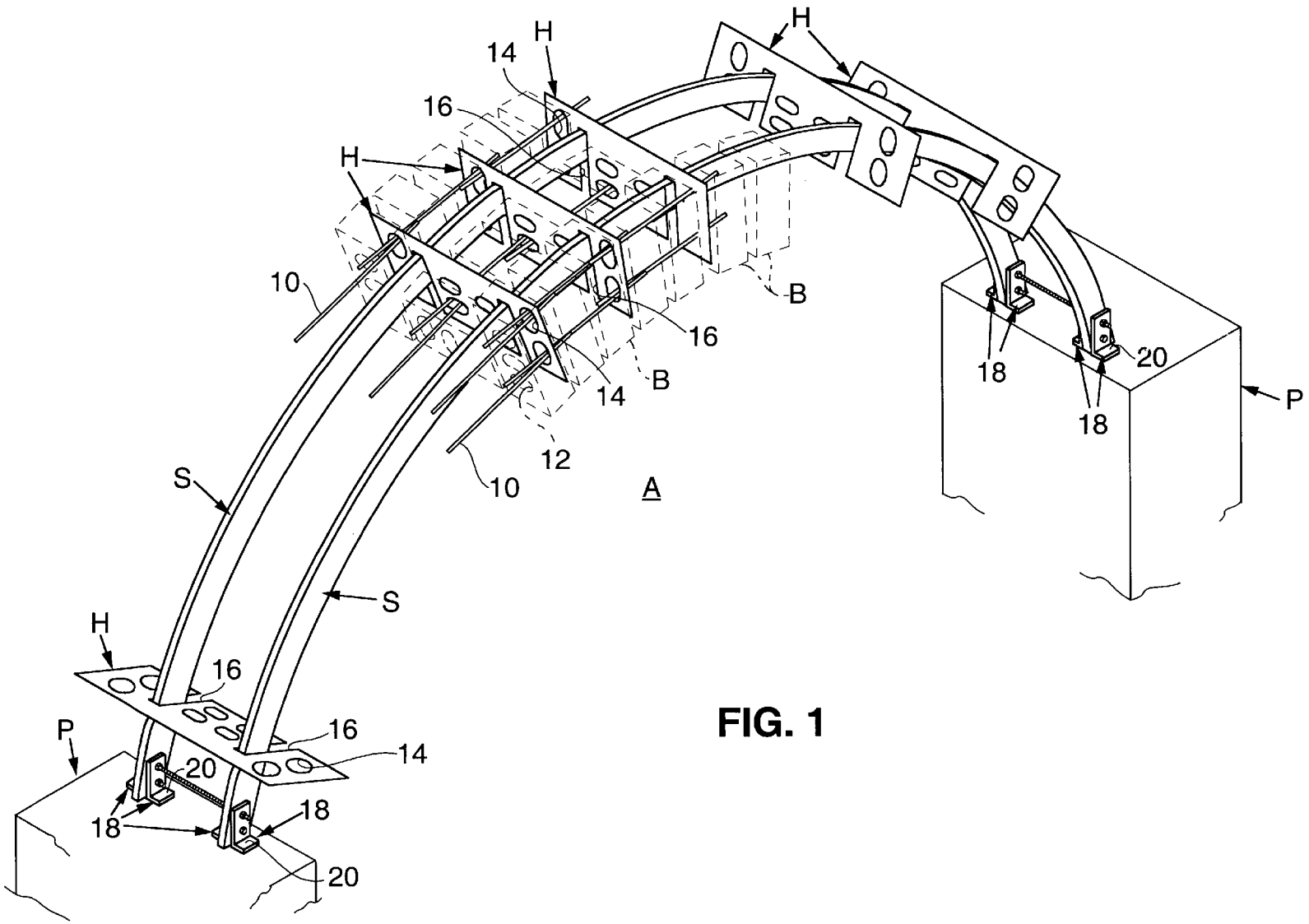
FIG. 1 is a perspective view illustrating a pair of concealed support spines for a masonry lintel wherein the ends of the spines are supported on piers through means of the apparatus and method of the present invention, with bricks shown in phantom supported on horseshoe plates carried by the spines.

FIG. 1 shows a concealed lintel system of the HALFEN type embodying the adjustable support system of the present invention. As there seen, piers P are disposed to either side of an area A to be arched. A pair of spine members S span the area A and are supported at their ends on the piers P. The spine members carry a horseshoe plates H which, in turn, carry cored bricks B through stitching rods 10 which extend through openings 12 in the bricks and openings 14 in the plates. The plates are formed with U-shaped slots 16 which engage over the spine members S. The openings 14 in the plates are disposed both to the outside and to the inside of the spines. The outside openings support bricks B to the outside of the spines. The inside openings supports bricks intermediate to spines. In a typical embodiment, the spines are fabricated from three-eighths inch steel plate, the horseshoe plates are fabricated of three-sixteenth thick plate and the stitching rods are fabricated of one-quarter inch diameter bar. The plate and bar elements are ideally either fabricated of a corrosion resistant steel, or hot-dipped galvanized steel. The stitching rod openings in the horseshoe plates P are of a elongate configuration and ideally correspond with at least two cored openings in the bricks.

In the course of constructing a lintel the bricks are positioned as shown in FIG. 1, with the horseshoe plates at three brick intervals, and the stitching rods are threaded through the openings in the plates and bricks. The openings in the bricks are packed with mortar around the stitching rods. The horseshoe plates are received in the grouting space between each third brick and the bricks are assembled so that a uniform grout space is provided therebetween. The grout space is filled with mortar. The bricks are supported on a form work (not illustrated) until such time as the mortar has sufficient strength to support the load of the bricks. After the form work is removed, the lintel is cleaned of excess mortar and the joints are pointed.

FIG. 1 illustrates a first embodiment of the inventive spine support system wherein angles 18 are disposed on the piers P to either side of each of the spines S. Each angle comprises a bearing plate portion 20 resting on top of the pier and an upright portion 22 extending vertically therefrom in generally parallel relationship to the spine member which it supports. (This arrangement may be seen in more detail in FIG. 10.)

Lower bolts 24 extend slidably through complimental openings therefor in the upright portions and through enlarged openings 26 in the spine members S. Elongate upper bolts 28 also extend through complimental openings therefor in the upright portions 20 and through enlarged openings 30 in the spine members S. The bolts 28 also span the space between the spine members S and, together with nuts 32 threadably received thereon serve as means to adjust the spacing of the spine members relative to one another. Vertical and horizontal adjustment of the support angles 18 relative to the spine members S is provided through means of the enlarged openings 26 and 30 in the spine members and the smaller diameter of the bolts 24 and 28 extending therethrough. In the course of such adjustments, the nuts on the bolts 24 and 28 are initially left in a loose condition so that the position of the angles 18 relative to the spines may be adjusted to position the bearing plate portions firmly on the piers. Once so adjusted, nuts 34 on the bolts 24 are tightened to clamp the spine members S between the upright portions 22. The inside nuts 32 on the elongate bolt 28 are then adjusted to provide the desired spacing of the spine members S and the outside bolts 32 are then tightened into place to both fix this condition of adjustment and further clamp the spine members S between the upright portions 22. The clamping action of the bolts functions to force the upright portions 22 into secure frictional engagement with the spine members S, thus selectively establishing a secure adjusted condition between the angles 18 and the spine members. Once fully adjusted and clamped, the bearing plate portions of the angles 18 are mortared into place on the piers.

Figure 3:
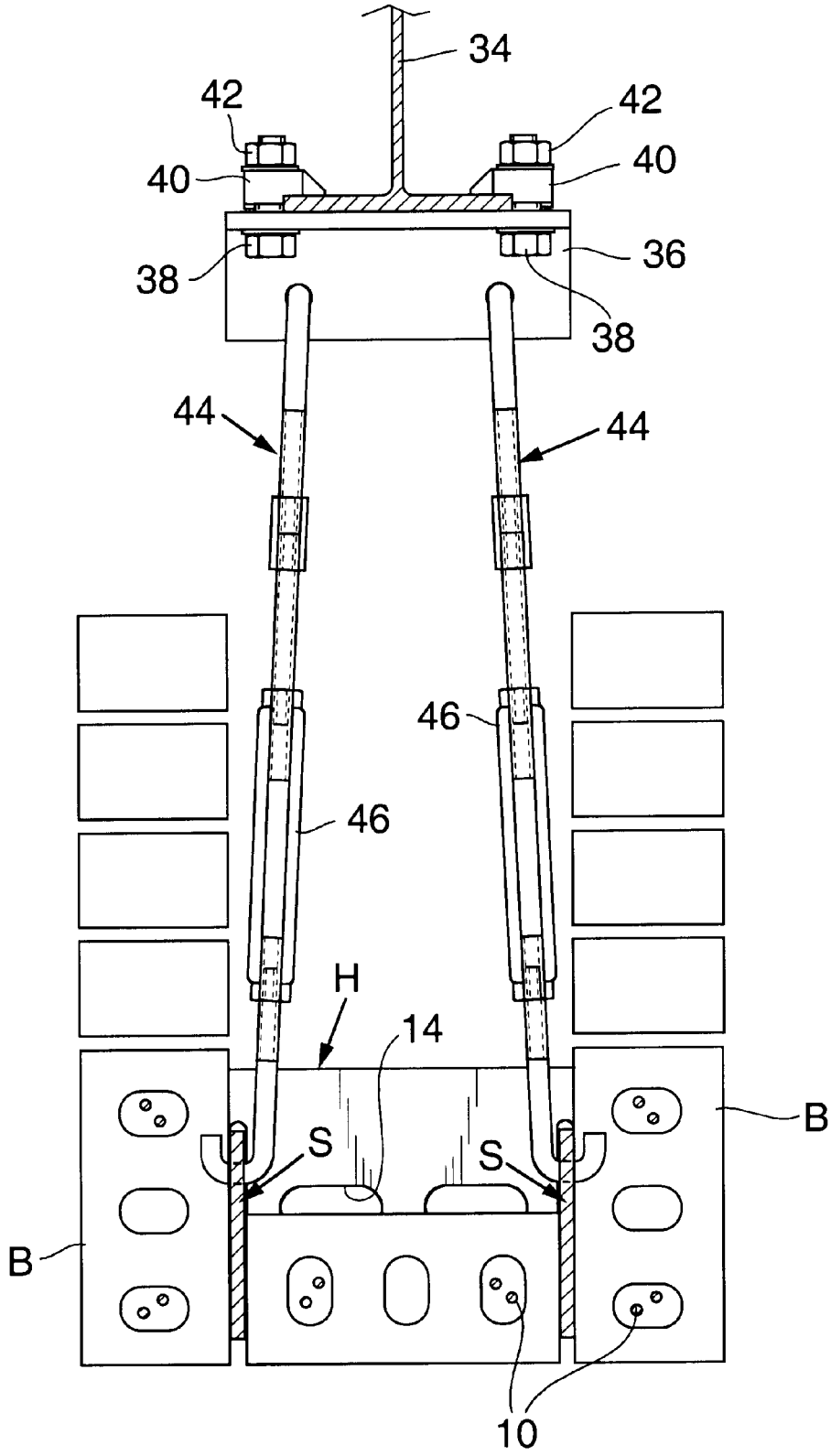
FIG. 3 is a cross-sectional elevational view illustrating a first embodiment of the adjustable intermediate support of the invention.

The adjustable intermediate support shown in FIG. 3 is secured to an I-beam 34 fixed above the area being arched. The first component of the adjustable intermediate support comprises a T-shaped or angle-shaped member 36 clamped to the I-beam. Clamping is provided by bolts 38 which extend through the T-shaped member, clamp elements 40 slidably received on the bolts, and nuts 42 threadably engaged with the bolts above the clamp elements 40. In the course of adjustment, the nuts are initially loosened to enable the clamp elements to slide on the I-beam, and once the desired condition of adjustment is achieved, the bolts are tightened to secure the T-shape member in place. Links 44 extend between the member 36 and the spine members S to suspend and lend intermediate support to the spine members. The ends of the links are hooked through apertures provided therefor in the member 36 and the spine members S. Turnbuckles 46 provide for select adjustment of the length of the links.

Figure 4A:
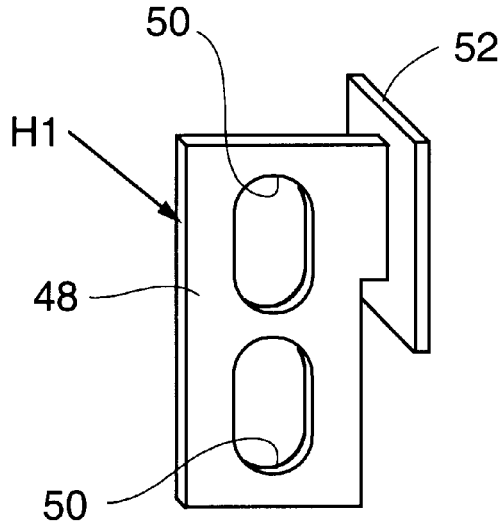
FIG. 4*a* is a perspective view illustrating a horseshoe plate designed to be hung from one side of a support spine.
Figure 4B:
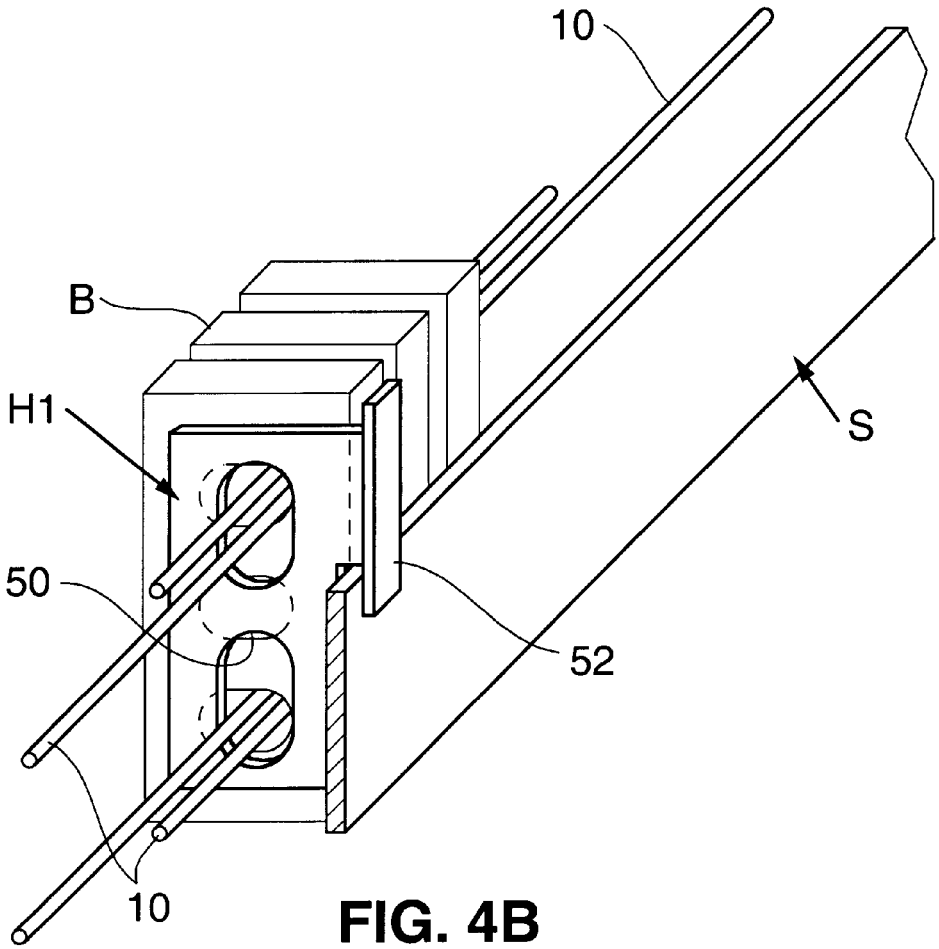
FIG. 4*b* is a perspective view of the horseshoe plate of FIG. 4*a*, shown hung from a spine member, with bricks suspended therefrom by stitching rods.

The horseshoe plate of FIG. 4A, designated H1, is designed for the construction of a lintel having a single brick width, as might be used for creating the appearance of a brick arch on the opening in a preexisting wall. It comprises a main plate portion 48 having oblong stitching rod openings 50 extending therethrough and a hanger plate 52 welded in normal relationship to the plate 48 for hooking over a spine member, as seen in FIG. 4B. The ends of the spine member would be supported on piers, or other support structure, through means of the adjustable support structure of the present invention, for example the first embodiment structure previously described with respect to FIGS. 1 and 10.

Figure 5:
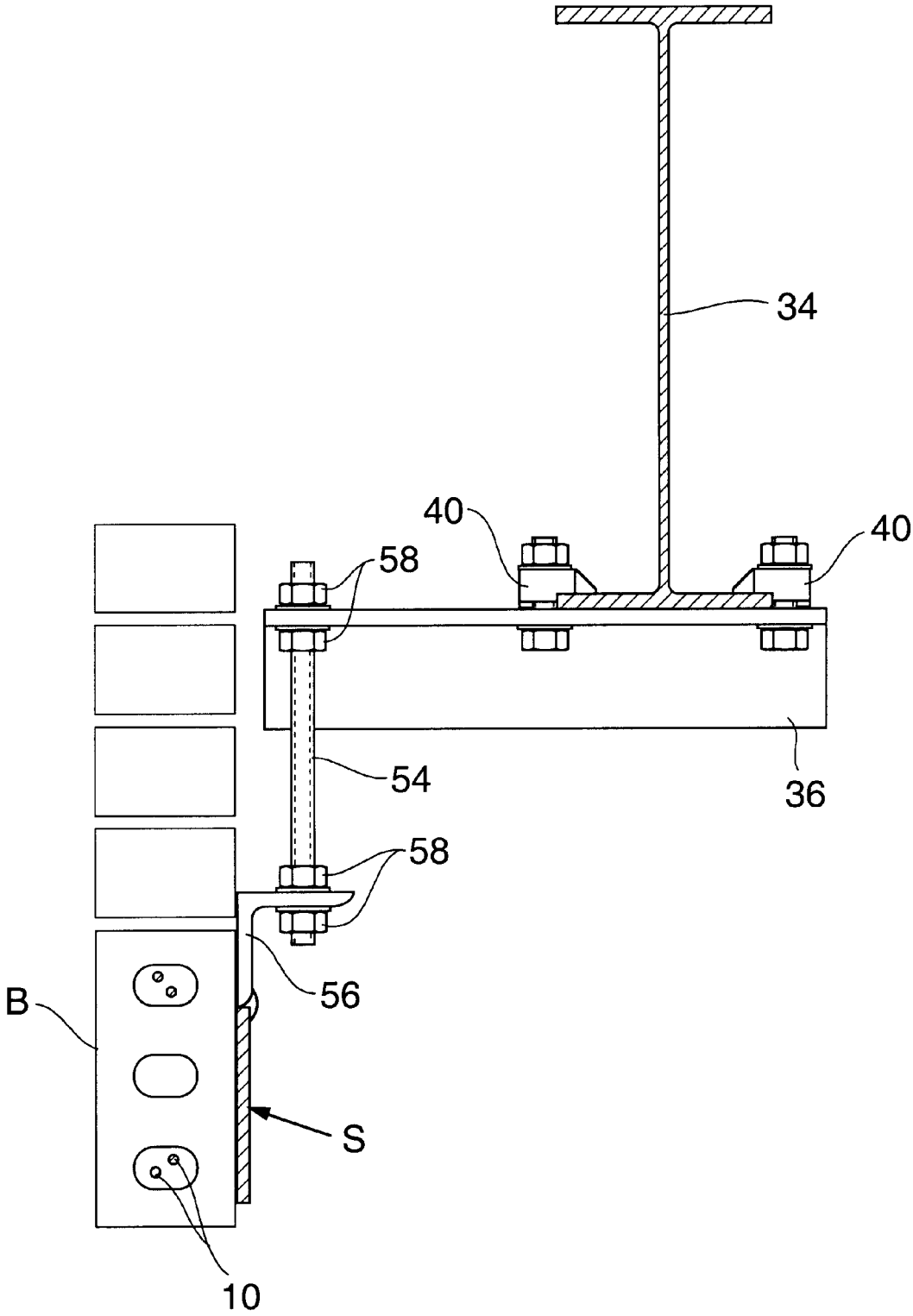
FIG. 5 is a cross-sectional elevational view of a second embodiment of the adjustable intermediate support of the invention.

The adjustable intermediate support of FIG. 5 may be used with a single thickness brick lintel, such as that shown in FIGS. 4A and 4B. It is of a construction similar to that of FIG. 3 in that it includes an I-beam 34, a T-shaped member 36 and bolted clamp elements 40. The T-shaped member, however, is asymmetrical relative to the I-beam and extends to one side thereof to support an elongate vertically extending bolt 54. The bolt 54 supports the spine member S through means of an angle 56 welded to the spine member. Nuts 58 are threadably engaged on the bolt 54 to either side of the horizontal flanges of the T-shaped member 36 and the angle. These nuts are selectively adjusted and tightened into place to adjust the length of the FIG. 5 support.

Figure 2:
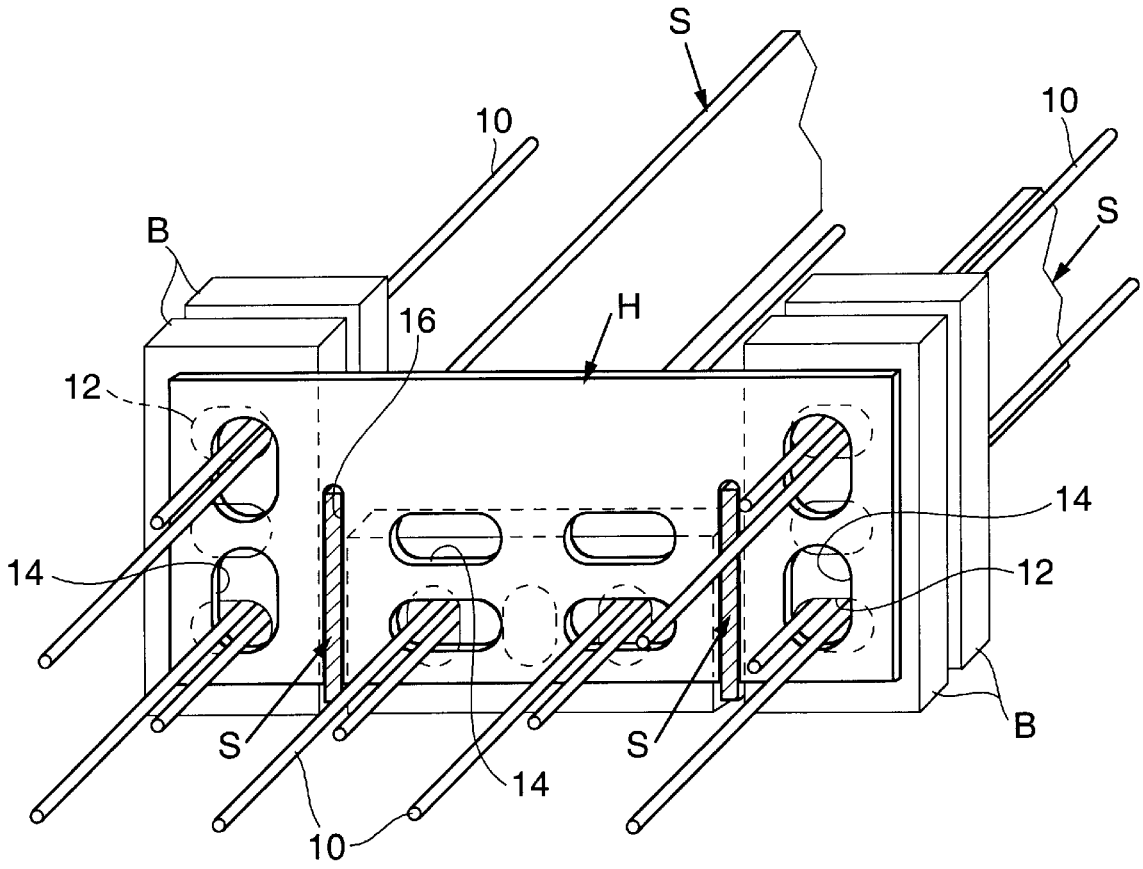
FIG. 2 is a perspective view, with parts thereof broken away, illustrating the detail of the spines and associated horseshoe plates and bricks of FIG. 1.
Figure 6:
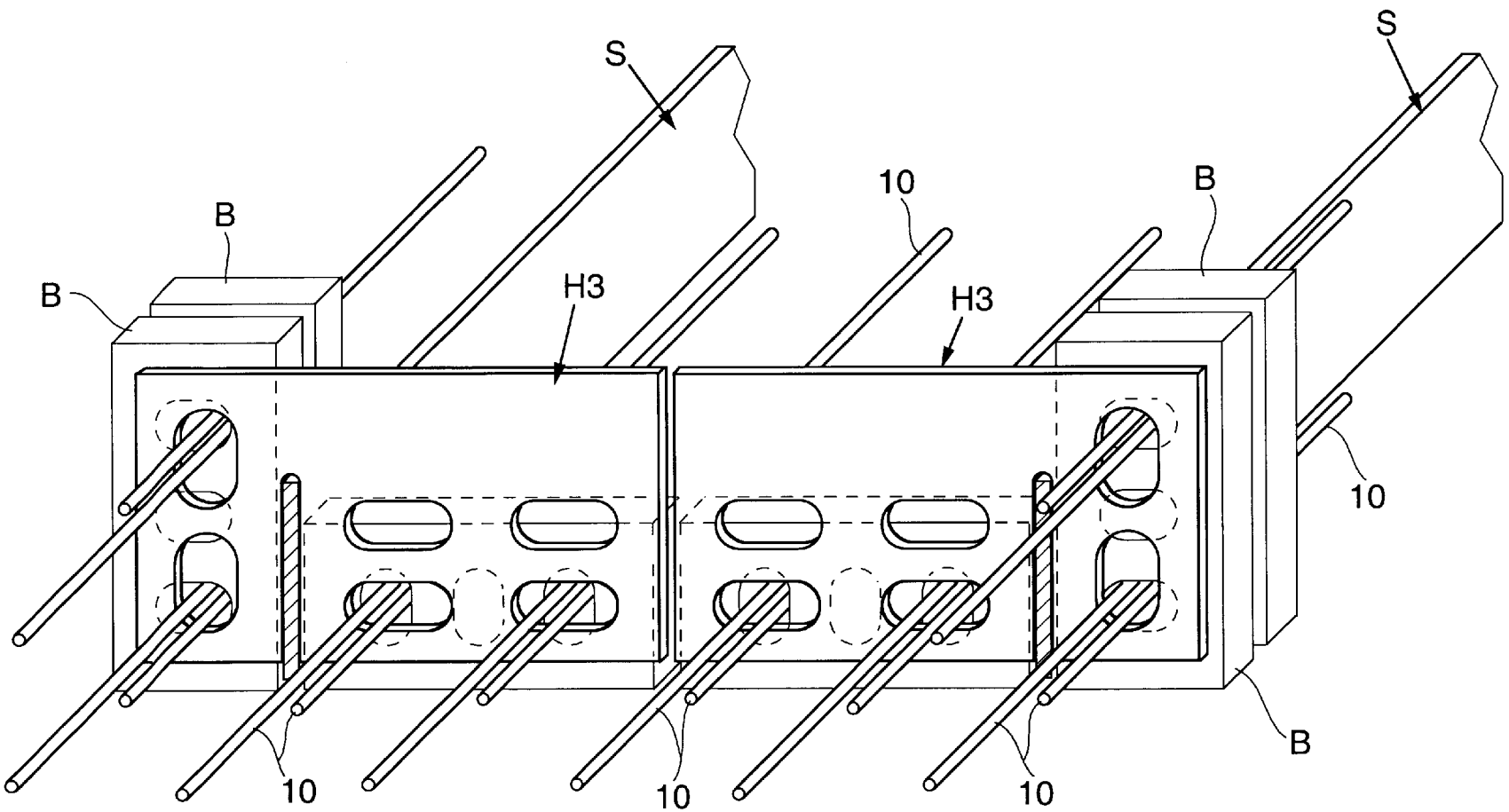
FIG. 6 is a perspective view, with parts thereof broken away, illustrating an embodiment wherein the support of the invention accommodates two spine members, each of which supports a separate horseshoe plate.

The modified arrangement of FIG. 6 differs from that of FIGS. 1 and 2 in that the spine members S are spaced apart by a greater distance and a separate horseshoe plate H3 is provided on each spine member. This arrangement accommodates different proportions and combinations of bricks intermediate to spine members. The adjustable supports of the present invention enable the spacing of the spine members to be adjusted to compliment such differences, while maintaining uniform grout width.

Figure 7:
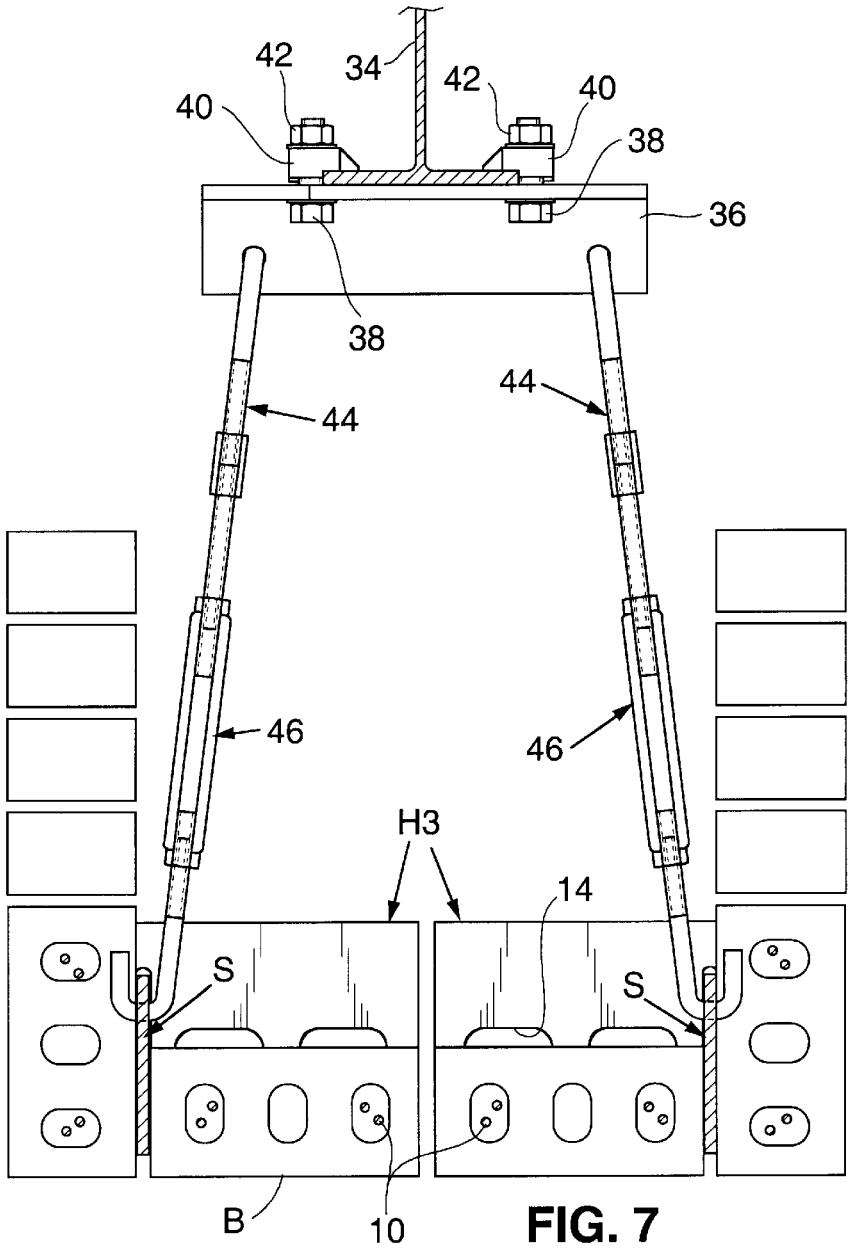
FIG. 7 is a cross-sectional elevational view, with parts thereof broken away, illustrating a third embodiment of the adjustable intermediate support of the invention.

The third embodiment adjustable intermediate support shown in FIG. 7 corresponds to the first embodiment shown in FIG. 3, except that it is the greater width to accommodate wider spacing of the spine members and the separate horse-shoe plates of FIG. 6. Accordingly, the elements of the FIG. 7 intermediate support are designated by numerals corresponding to those used for the like elements of the FIG. 3 embodiment. Like the FIG. 3 embodiment, the FIG. 7 embodiment provides for adjustment of the intermediate support both longitudinally and vertically, relative to the fixed I-beam 34.

Figure 8:
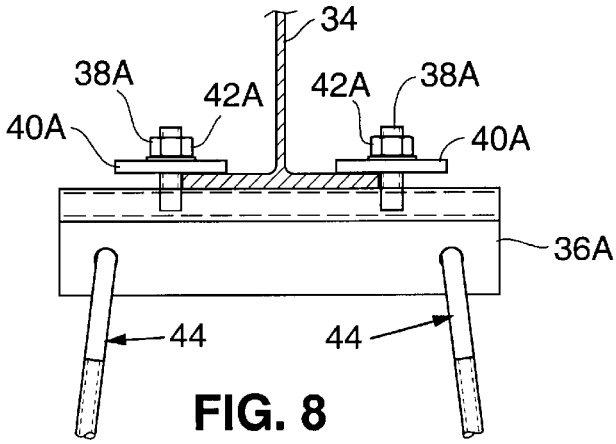
FIG. 8 is a cross-sectional elevational view, with parts thereof broken away, illustrating a modification of the third embodiment intermediate support of FIG. 7.

The modification of the third embodiment intermediate support shown in FIG. 8 differs from that of FIG. 7 only in the construction of the T-shaped member, designated 36A and the clamp elements which secure the member 36A to the I-beam 34. The top of the T-shape member 36A is formed with what is known as a HALPEN channel for slidably receipt of special bolts 38A which carry washer like clamp elements 40A and threadably receive clamping nuts 42A. When the nuts 42A are loosened, the bolts 38A may be slid over the flange of the I-beam 34 to enable the T-shaped member to be adjusted in position relative to the I-beam both longitudinally and transversely. Once in the desired position of adjustment, tightening of the nuts 42A serves to fix the position of the T-shaped member 36A relative to the I-beam.

Figure 9:
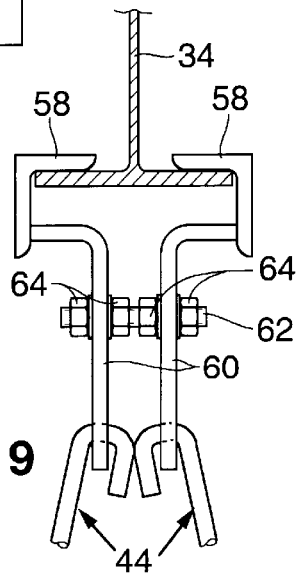
FIG. 9 is a cross-sectional elevational view, with parts thereof broken away, illustrating a fourth embodiment of the adjustable intermediate support of the invention.

The fourth embodiment intermediate support of FIG. 9 differs from the first embodiment of FIG. 3 only in the construction of the clamp used to secure the intermediate support to the I-beam 34. In the FIG. 9 embodiment, the clamp comprises angle-shaped members 58 engaged over the lower flange of the I-beam, which members have intermediate L-shaped extensions 60 welded thereto and extending downwardly therefrom. The extensions are adjustably secured together by a threaded rod 62 extending therethrough and nuts threadably engaged with the rod to either side of each of the extensions. The nuts are adjusted and tightened in place to lock the angle-shaped members 58 in select conditions of adjustment relative to the I-beam 34. Links 44, corresponding to those of the FIG. 3 embodiment, adjustably suspend the spine members (not illustrated) from the FIG. 9 clamp.

The second embodiment bearing plate construction (FIG. 11) differs from the first embodiment in that a single T-shaped support 66 is provided for each of the spine members S in place of the paired angles 18. Each T-shaped support comprises a bearing plate portion 68 having an upright portion 70 welded thereto. The upright portions 70 are bolted to the spine members S through means of lower bolts 24 and elongate bolts 28 corresponding to the like numbered bolts of the first embodiment support illustrated in FIG. 10. The bolts 24 and 28 extend through complimental openings therefor in the upright portions 70 and through enlarged openings 26, 30 in the spine members. Like the first embodiment of FIG. 10, the enlarged openings 26 and 30 of the FIG. 11 embodiment permit the spine members to be adjusted horizontally and vertically relative to the bearing plate portions 68. Tightening of the bolts through means of the nuts thereon serves to clamp the spine members to the upright portion 70. The nuts on the elongate bolt 28 also accommodate adjustment of the spine members towards and away from each other.

Figure 10:
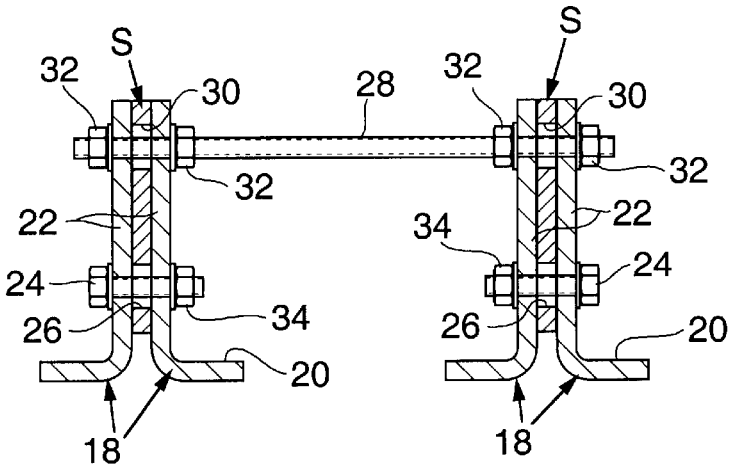
FIG. 10 is an elevational view, with parts thereof shown in section, illustrating a first embodiment of the bearing plate construction of the invention.
Figure 12:
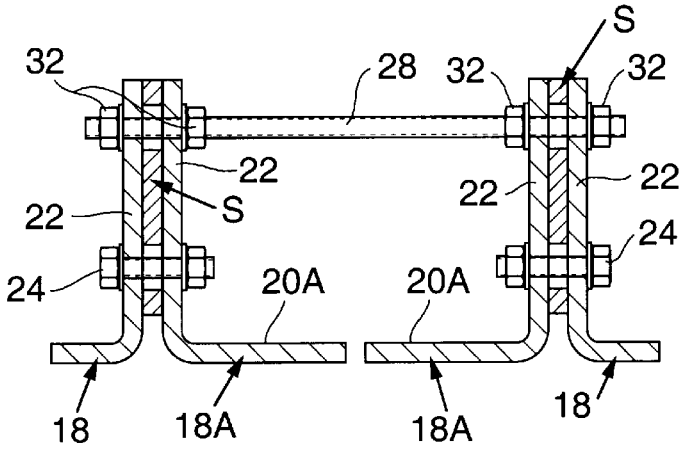
FIG. 12 is an elevational view, with parts thereof shown in section, illustrating a third embodiment of the bearing plate construction of the invention.

The third embodiment bearing plate construction of FIG. 12 corresponds identically to the first embodiment construction of FIG. 10, except that the inner angles, designated 18A, are provided with more elongate bearing plate portions 20A. These more elongate portions provide additional stability and are desirable in applications of the invention where the distance between paired spine members is increased.

Figure 11:
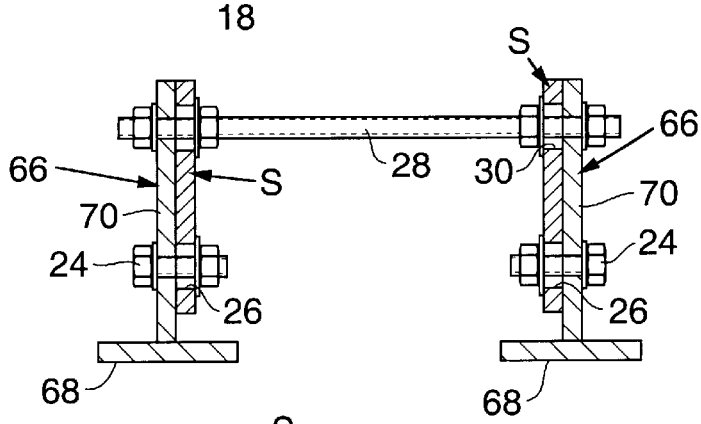
FIG. 11 is an elevational view, with parts thereof shown in section, illustrating a second embodiment of the bearing plate construction of the invention.
Figure 13:
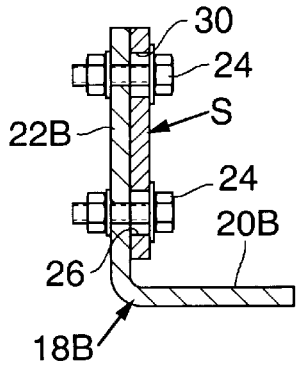
FIG. 13 is an elevational view, with parts thereof shown in section, illustrating a fourth embodiment of the bearing plate construction of the invention.

The fourth embodiment bearing plate construction of FIG. 13 is essentially a variation of the second embodiment of FIG. 11, wherein the single support plate for the spine member S comprises an L-shaped angle 18B, rather than a T-shaped member. The L-shaped member 18B has a lower bearing plate portion 20B and an upright portion 22B. As shown in FIG. 13, however, a single spine member, only, is supported on the angle 18B. Short bolts 24 extend through the enlarged openings 26, 30 of the spine member and complimental openings therefor in the upright portion 22B. Like the other embodiments, the enlarged openings in the spine member permit adjustments of the spine member relative to the angle 18B. Tightening of the bolts serves to secure the spine members in adjusted condition.

Figure 14:
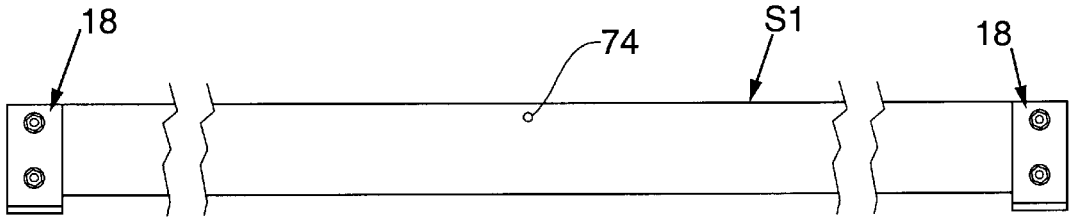
FIG. 14 is side-elevational view, illustrating the bearing plate construction of the present invention supporting a generally rectilinear spine.

FIG. 14 illustrates that the support structure of the present invention may be used to adjustably support a generally rectilinear spine member, designated S1. As there shown, the spine member S1 is provided with a centrally disposed aperture 74 for receipt of an intermediate support link, such as that shown in FIG. 3.

Figure 15:
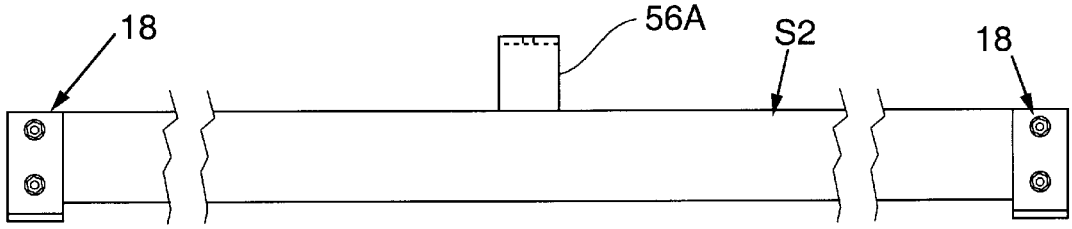
FIG. 15 is a side-elevational view similar to FIG. 14, illustrating the bearing plate construction of the present invention supporting a rectilinear spine with an intermediate support.

FIG. 15 also shows the support system of the present invention used to support a generally rectilinear spine member, designated S2. The spine member S2 has an angle 56A, similar to the angle 56 of the FIG. 5 embodiment, welded thereto intermediate S-ends for engagement with an intermediate support such as that shown in FIG. 5.

CONCLUSION

All embodiments of the present invention provide multi-directional adjustment for the lintel support, thus avoiding the requirement that special supports be preconstructed for each job. The invention is defined in the following claims.

We claim:

1. In combination with a lintel comprising a first spine member extending between spaced piers disposed to either side of an area to be arched and support plates slidably mounted on the spine member to suspend cored bricks from the spine member through means of stitching rods extending through apertures in the plates and bricks, the improvement comprising:

a first bearing plate on each of the piers, said plates having upright portions extending vertically therefrom in generally parallel relations up to the spine member; and, b. bolted connections between the upright portions of the bearing plates and the first spine member to selectively secure the first spine member at different positions of adjustment relative to the first bearing plates.

2. In a combination according to claim 1, the improvement wherein the bolted connection comprise:

a. bolts extending through generally aligned openings therefor in the spine and upright portions, at least one of which openings for each bolt is larger than the bolt extending therethrough to accommodate movement of the spine relative to the upright portions; and, b. nuts threadably received on the bolts to selectively force the spine and upright portions into compression imparting relationship with one another.

3. In a combination according to claim 1, the improvement wherein a pair of first bearing plates are supported on each pier to provide upright portions to either side of the first spine member and the bolted connections extend through the upright portions of the paired bearing plates to secure the first spine member therebetween.

4. In a combination according to claim 3, the improvement wherein the bolted connections comprise:

a. bolts extending through generally aligned openings therefor in the spine member and upright portions, at least one of which openings for each bolt is larger th the bolt extending therethrough to accommodate movement of the spine member relative to the upright portions; and, b. nuts threadably received on the bolts to selectively force the spine member and upright portions into compression imparting relationship with one another.

5. In a combination according to claim 1 wherein a second spine member extends between the piers in spaced generally parallel relationship to the first spine member and the support plates are slidably mounted on the first and second spine members, the improvement further comprising:

a. a second bearing plate on each of the piers, said second bearing plates having upright portions extending vertically therefrom in generally parallel relationship to the second spine member; and b. bolted connections between the upright portions of the second bearing plates and the second spine member to selectively secure the second spine member at different positions of adjustment relative to the second bearing plates.

6. In a combination according to claim 5, the improvement wherein the bolted connections comprise:

a. bolts extending through generally aligned openings therefor in the spine members and upright portions, at least one of which openings for each bolt is larger than the bolt extending therethrough to accommodate movement of the spine members relative to the upright portions; and, b. nuts threadably received on the bolts to selectively force the spine members and upright portions into compression imparting relationship with one another.

7. In a combination according to claim 4, the improvement wherein a pair of first bearing plates is supported on each pier to provide upright portions to either side of the first spine member and the bolted connections between the upright portions of the first bearing plates and the spine member extend through the upright portions of the paired bearing plates to secure the first spine member therebetween.

8. In a combination according to claim 7, the improvement wherein a pair of second bearing plates is supported on each of the piers to provide upright portions to either side of the second spine member and the bolted connections between the upright portions of the second bearing plates and the second spine member extend through the upright portions of the paired second bearing plates to secure the second spine member therebetween.

9. In a combination according to claim 5, the improvement further comprising means to selectively adjust the relative spacing of the upright portions of the first and second bearing plates on each pier to adjust the spacing of the first and second spine members.

10. In a combination according to claim 9, the improvement wherein the means to selectively adjust the spacing of the first and second bearing plates comprises threaded bolts extending through and between the upright portions of the first and second bearing plates and nuts threadably received on the bolts for engagement with the upright portions of the first and second bearing plates.

11. In a combination according to claim 1 wherein intermediate support structure is disposed between and above the piers, the improvement further comprising adjustable length upper supports secured between the intermediate support structure and the first spine member.

12. In a combination according to claim 11, the improvement further comprising means to selectively adjust the position of the upper supports relative to the intermediate support structure.

13. In combination with a lintel comprising a first spine member extending between spaced piers disposed to either side of an area to be arched and support plates slidably mounted on the spine member to suspend cored bricks from the spine member through means of stitching rods extending through apertures in the plates and bricks, the improvement comprising:

a. bearing plate means on each of the piers to support the first spine member on the piers, said means being separate from the first spine member; and b. attachment means to selectively secure the first spine member to the bearing plate means at different positions of adjustment relative thereto.

14. In a combination according to claim 13 wherein a second spine member extends between the piers in spaced generally parallel relationship to the first spine member and the support plates are slidably mounted on the first and second spine members, the improvement wherein:

a. the bearing plate means is separate from and supports the second spine member; and b. the attachment means is selectively operable to secure the second spine member to the bearing plate means at different positions of adjustment relative thereto.

15. In a combination according to claim 14, the improvement wherein the bearing plate means is selectively adjustable to adjust the spacing of the first and second spine members.

16. In a combination according to claim 13, wherein intermediate support structure is disposed between and above the piers, the improvement further comprising adjustable length upper supports secured between the intermediate support structure and the first spine member.

17. In a combination according to claim 16, the improvement further comprising means to selectively adjust the position of the upper supports relative to the intermediate support structure.

18. In combination with a lintel comprising a first spine member extending between spaced piers disposed to either side of an area to be arched and support plates slidably mounted on the spine member to suspend cored bricks from the spine member through means of stitching rods extending through apertures in the plates and bricks, an improved method for supporting the spine member on the piers, comprising:

a. providing a bearing plate means on each of the piers supporting the spine member on the piers, the bearing plate means on at least one of the piers being separate from the spine member for movement between different positions of adjustment relative thereto; and b. providing attachment means selectively securing the spine member to the bearing plate means on said at least one pier at a desired position of adjustment relative thereto.

19. In a combination with a lintel comprising first and second spine members extending between spaced piers disposed to either side of an area to be arched and support plates slidably mounted on the spine members to suspend cored bricks from the spine members through means of stitching rods extending through apertures in the plates and bricks, an improved method for supporting the spine members on the piers, comprising:

a. providing a bearing plate means on each of the piers supporting the spine members on the piers, the bearing plate mean on at least one of the piers being separate from the spine members for movement between different positions of adjustment relative thereto; and b. providing attachment means selectively securing the spine members to the bearing plate means on said at least one pier at a desired position of adjustment relative thereto.

20. An improved method for supporting a spine member concealed within a masonry lintel on a support structure disposed to one end of the lintel, said method comprising:

a. providing a bearing plate means on the support structure supporting the spine member on the structure, said means being separate from the spine member for movement between different positions of adjustment relative thereto; and b. providing attachment means selectively securing the spine member to the bearing plate means at a desired condition of adjustment relative thereto.

21. An improved method for supporting a pair of spine members concealed within a masonry lintel on a support structure disposed to one end of the lintel, said method comprising:

a. providing a bearing plate means on the support structure supporting the spine members on the structure, said means being separate from the spine members for movement between different positions of adjustment relative thereto; and b. providing attachment means selectively securing the spine members to the bearing plate means at a desired condition of adjustment relative thereto.

* * * * *